US009016786B2

(12) United States Patent
Glöckl

(10) Patent No.: US 9,016,786 B2
(45) Date of Patent: Apr. 28, 2015

(54) MOVEABLE ITEM OF SEATING FURNITURE COMPRISING A DEVICE FOR CONTROLLING THE RETURN FORCE

(76) Inventor: Josef Glöckl, Kirchheim (DE)

( * ) Notice: Subject to any disclaimer, the term of this patent is extended or adjusted under 35 U.S.C. 154(b) by 588 days.

(21) Appl. No.: 13/318,674

(22) PCT Filed: May 6, 2010

(86) PCT No.: PCT/EP2010/056149

§ 371 (c)(1),
(2), (4) Date: Jan. 16, 2012

(87) PCT Pub. No.: WO2010/136312

PCT Pub. Date: Dec. 2, 2010

(65) Prior Publication Data

US 2012/0126599 A1 May 24, 2012

(30) Foreign Application Priority Data

May 6, 2009 (DE) ..... 10 2009 019 880

(51) Int. Cl.
*A47C 3/22* (2006.01)

(52) U.S. Cl.
CPC ..... *A47C 3/22* (2013.01)

(58) Field of Classification Search
CPC ..... A47C 3/22
USPC ..... 297/313, 338
See application file for complete search history.

(56) References Cited

U.S. PATENT DOCUMENTS

| | | | | |
|---|---|---|---|---|
| 4,099,697 | A * | 7/1978 | Von Schuckmann | 297/314 |
| 5,921,628 | A * | 7/1999 | Glockl | 297/338 X |
| 6,206,335 | B1 * | 3/2001 | Huber et al. | 297/313 |
| 7,547,067 | B2 * | 6/2009 | Keilhauer et al. | 297/313 |
| 8,066,624 | B1 * | 11/2011 | Stroup | 297/338 |

FOREIGN PATENT DOCUMENTS

| | | | |
|---|---|---|---|
| DE | 24 06 338 | A1 | 8/1975 |
| DE | 44 28 259 | A1 | 2/1996 |
| DE | 10 2005 009684 | A1 | 9/2006 |
| DE | 20 2007 011750 | U1 | 11/2007 |
| EP | 1106111 | A1 | 6/2001 |
| WO | WO 2009/024329 | A1 | 2/2009 |

OTHER PUBLICATIONS

International Search Report (in German with English translation) and Written Opinion (in German) for PCT/US2010/056149, mailed Nov. 4, 2010; ISA/EP.

* cited by examiner

*Primary Examiner* — Anthony D Barfield
(74) *Attorney, Agent, or Firm* — Harness, Dickey & Pierce, P.L.C.

(57) ABSTRACT

The invention relates to an item of seating furniture comprising a seat, a column, a base, a spring device for cushioning the up and down movement of the seat and a pendulum device for inducing a pendular response of the column by means of the seat, and a device for automatically adjusting the pendular return force in accordance with the weight of a person occupying the seat.

28 Claims, 4 Drawing Sheets

Figure 1:
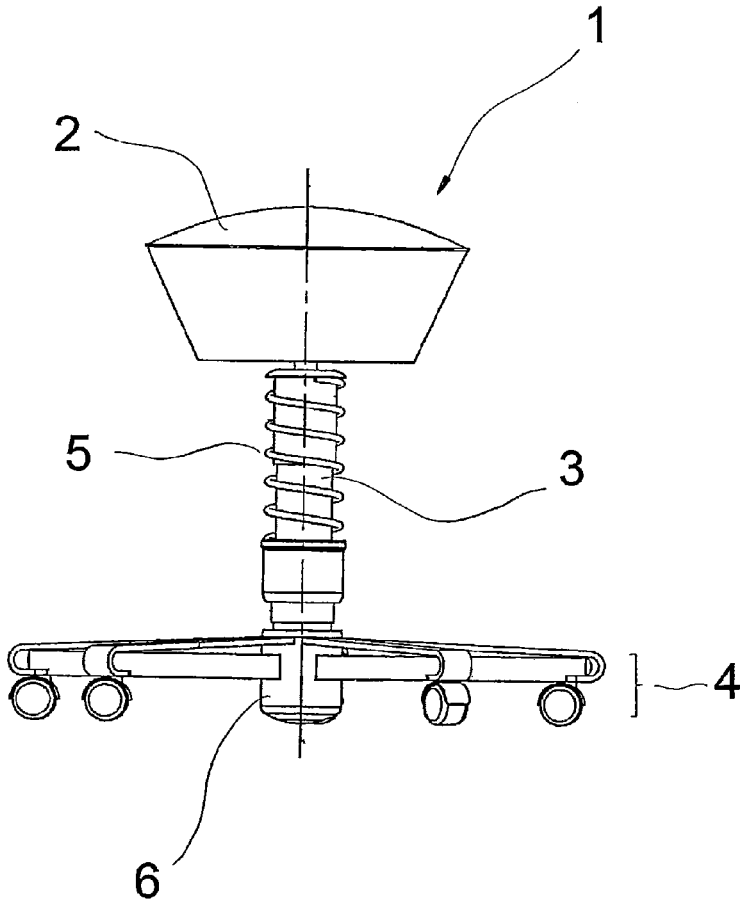

MOVEABLE ITEM OF SEATING FURNITURE COMPRISING A DEVICE FOR CONTROLLING THE RETURN FORCE

CROSS-REFERENCE TO RELATED APPLICATIONS

This application is a 371 U.S. National Stage of International Application No. PCT/EP2010/056149, filed May 6, 2010, and claims priority to German patent application No. 10 2009 019 880.6, filed May 6, 2009, the disclosures of which are herein incorporated by reference in their entirety.

The invention relates to an item of seating furniture comprising a seat, a column, a base, a spring device for cushioning the up and down movement of the seat and a pendulum device for inducing a pendular response of the column by means of the seat.

PRIOR ART

Known from German patent 44 00 395 A1 is a generic item of seating furniture also termed rocking chair providing tilting of the seat in all directions by a guided link and an elastic resetting element. In this arrangement the link is configured as a ball joint and the resetting element consists substantially of a rubber ring nesting the joint. The seat directly tops the ball joint.

The drawback in this design is that the tilting of the seat cannot be altered or set. The otherwise tilting availability of the seat in all directions is limited simply by stopper brackets.

A generic moveable item of seating furniture is known from the EP 0 808 116 B1 termed a rocking or pendulating stool comprising in the base a resetting device engineered in rubber-bonded metal featuring a tubular upper portion, a lower portion with the elastic material sandwiched inbetween. In this arrangement the lower portion, firmly secured to an arm of the base, cups the upper portion, the elastic material being disposed not only between the ends but also between the sidewalls. Upper and lower portion are connected to each other by a bolt, the nut of which enables the resetting device to be preset in thus enabling its return force to be set.

Thus, depending on the weight of a person to be seated the lateral wobble can be altered by means of the set nut. The drawback of this setting is that it is only possible when the user of the stool stands up to then adjust the return force by means of the nut.

This is a nuisance and the reason why the user usually fails to take the trouble to make the setting. Indeed, only very few users are even aware of this setting being available.

But correctly setting the lateral wobble is very important for proper use because if the setting of the lateral wobble is made too harsh the seat is unable to provide the required excursion or only minimally when a lightweight user is involved. This results in the seat being incapable of diving forward to accommodate the user leaning forward with no positive pelvic tilt forward in thus failing to counteract promotion of a stoop. Accordingly any forward tilt of the pelvis only occurs when allowed by the seat.

As explained above, prior art seats fail to make this possible because the pelvis is maintained in position with no accommodating tilt and the user has to stoop to lean forward to bridge the space between seat and worktop.

On the other hand, if the lateral wobble is set too pliant when the user of the seat is a heavy person then the response of the available tilt is experienced by the user as being too liable to tilt, prompting the user to readjust his balance all the time by muscular action of the lower back to compensate a sudden dive of the seat.

Anyone having no muscular training in this respect is hardly able to do this. Thus, an excessively soft lateral wobble setting is experienced by heavier weight persons not only as very uncomfortable, but will also overtax all parts of the body involved in being seated, causing injury thereto in the long run.

This is why there has been a long-standing requirement for a means for automatically setting the resistance to lateral wobble in:

- avoiding the drawbacks of a wrong setting of the lateral wobble in accordance with the weight of the seat user, and
- doing away with the need to read complicated instructions for use as to how to make the various settings in the resistance to lateral wobble.

With the advantages of it now being possible

- to medically correct the set resistance of the lateral wobble irrespective of the person involved in avoiding harm to the user because of a wrong setting as cannot be implemented correctly by the user himself.

OBJECT

Accordingly, the present invention is based on the object of the lateral wobble being automatically correctly set in accordance with the weight of the person using the seat.

ACHIEVEMENT

This object is achieved in accordance with the invention of a generic item of seating furniture in that deeper sinkage of a suspension strut due to the higher weight of the seat user lengthens the lever arm in a lower bearing of the center column, adding to the resistance to lateral wobble.

The item of seating furniture item in accordance with the invention substantially uses a seat, a column, a base, a spring device for cushioning the up and down movement of the seat and a pendulum device for inducing a pendular response of the column by means of the seat, and a means for automatically setting the pendular return force in accordance with the weight of the person using the seat.

One advantage of the means for automatically setting the return force is avoiding a wrong setting of the lateral wobble of the seat. This saves seat users from harm, for example, due to excessive lower back stress with the danger of a slipped disk in the S1/L5 or L5/L4 region or even a prolapsed disk. This is why making optimum use of an actively dynamic engineered seat in correctly setting the resistance to lateral wobble constitutes a major health benefit for the user.

It is favorably engineered so that the column or part of the column or a control element has a sinking action in use of the seat by a person, the extent of which sets the length of return lever arm between a pendulum fulcrum and a striking point of the return force.

This thus now makes it possible to restrict the pendular response of the column in accordance with the weight of the person using the seat.

For this purpose it is favorable when the control element takes the form of a hollow cylinder, it being a further advantage when one end of the control element is at least closed off since this saves both weight and material whilst enabling a gas strut or part thereof to sink into the hollow cylinder. Preferably a mount for the gas strut is provided within the control element.

In one particularly preferred embodiment the mount is arranged at the cylindrical bottom of the control element or at the inner end.

This permits damping the shock against the end in the sinking action of the hollow cylinder control element whilst supporting or stabilizing the gas strut when bottoming the inside of the end.

In this arrangement it is furthermore possible that the bottom inside mount is engineered as a elastomeric element to minimize jolting and the associated noise and wear and tear of the jolting components.

The control element favorably comprises a mount for a spring at the outer side of the closed end which in a preferred configuration is formed funnel-shaped.

Preferably the pendulum device features a housing which to advantage is tubular capable of being closed off by a cover at one end.

For cooperation of the tubular housing and the control element it is favorable when part of the control element is arranged in the tubular housing of the pendulum device.

So that the control element can be held guided in the tubular housing, the housing preferably features at least one mount for at least one toroidal elastomeric element.

In this arrangement at least one elastomeric element is favorably arranged within the housing of the pendulum device enabling it to not only bridge but also close off the space between control element and housing. Furthermore the elastomeric element may serve as part of a mounting fixture.

To achieve as large a lever arm as possible it is conducive when the at least one elastomeric element is arranged at the open end of the housing of the pendulum device. This not only affords the advantages for the lever arm in itself but also a safety-relevant aspect by now making finger-trapping impossible between the tubular housing and the control element in thus making this arrangement suitable also for a seating furniture item for children.

For automatically setting the pendular return force in accordance with the weight of the person using the seat the housing may preferably comprise an interior spring in thus making it possible to regulate the sinking travel of the control element or funnel-shaped mounting of the control element in the interior of the tubular housing.

Regulating this depends, for one thing, on the weight of the person using the seat and of the spring used and, for another, on the preload of the spring.

So that the control element seats the toroidal elastomeric element properly the at least one elastomeric element favorably needs to have a diameter equal to or smaller than the diameter of the control element.

Having the same or smaller diameter of the elastomeric element as compared to that of the control element is not only conducive for preventing dirt ingress into the tubular housing of the pendulum device, but it can also serve to restrict the pendular response.

In this arrangement it is furthermore an advantage when part of the tubular cylindrical is flared on the outer side to reinforce the effect of a more stronger lateral wobble for a heavy person making use of the seat since mounting the control element within the housing of the pendulum device has a higher degree of tensioning, resulting in the mounting becoming stiffer.

For the at least one elastomeric element it is an advantage when it comprises at least one portion with a differing degree of hardness. To advantage this at least one portion may be arranged at the circumference.

This at least one portion with a differing degree of hardness arranged at the circumference has the inherent advantage of certain portions of the lateral wobble can be made more difficult or even blocked altogether.

This may be an advantage, for instance, when the seat has a backrest, in which case a pendular response in the direction of the backrest can be blocked in the part of the seat facing the backrest to prevent stooping.

Conductively the housing of the pendulum device or the cover features a device for tweaking the loading of the spring in thus enabling an already preloaded spring to be tweaked by simple ways and means after assembly of the control element and housing of the pendulum device.

Because of it being able to engineer the various portions with a differing degree of hardness of the elastomeric elements, favorably the housing of the pendulum device is arranged rotatable in a support.

To achieve this rotation at least one bearing assembly is preferably disposed between the housing and pendulum device and the support in thus making it possible when the invention features a backrest to orient the specifically configured degree of hardness of the elastomeric elements in the direction of the backrest.

To keep out dirt and to prevent the housing of the pendulum device from being pulled out of its support the support is covered to advantage.

To optimize the variability in application of the seat it is an advantage when the support is arranged on a star base.

When the star base is castored, the seat is easy to shift when devised for use by children or in the office.

It is understood that the special configuration of the pendulum device as described is not intended for just a certain kind of seating furniture item but for any such item for retrofitting with a gas strut.

Figure 2A:
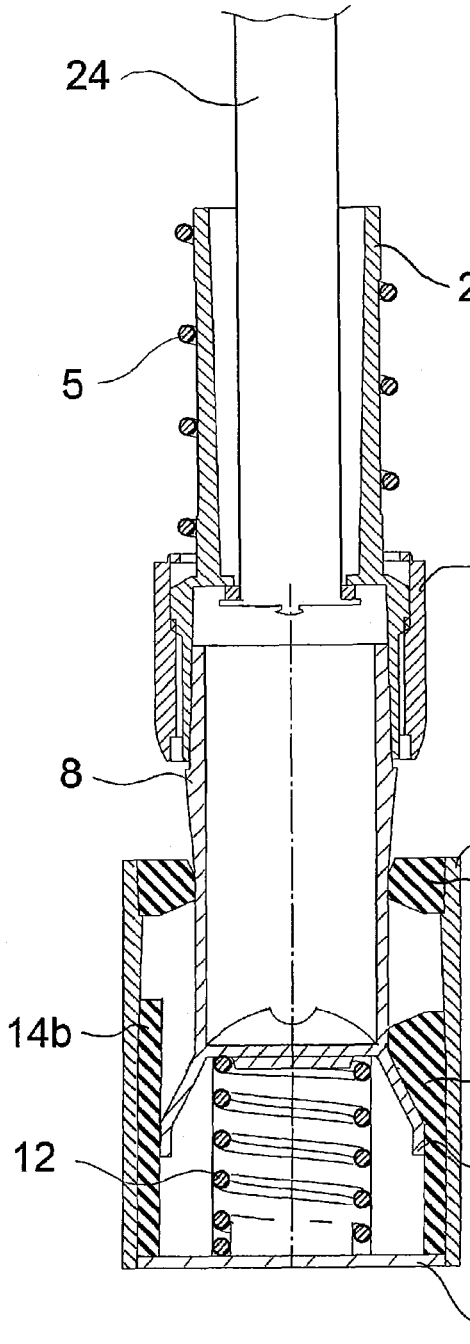
Figure 2B:
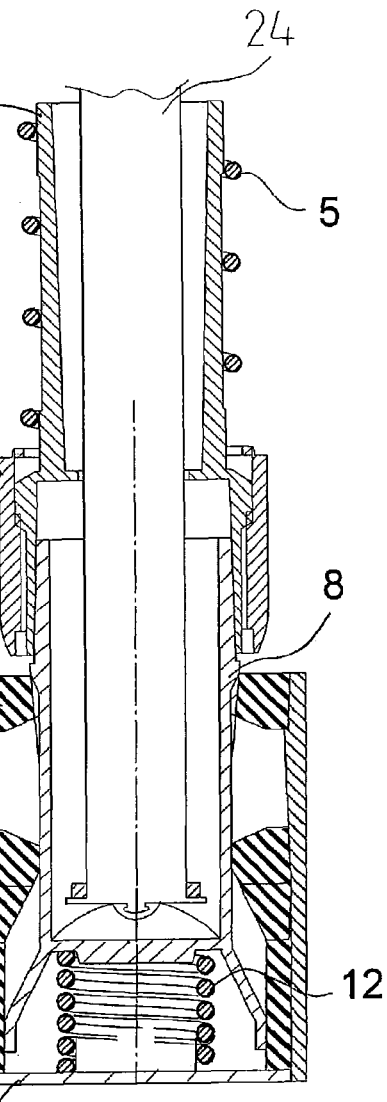
Figure 4:
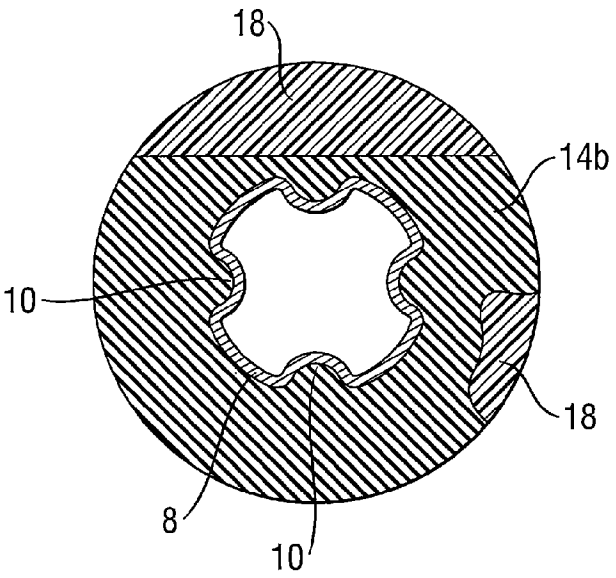
Figure 3:
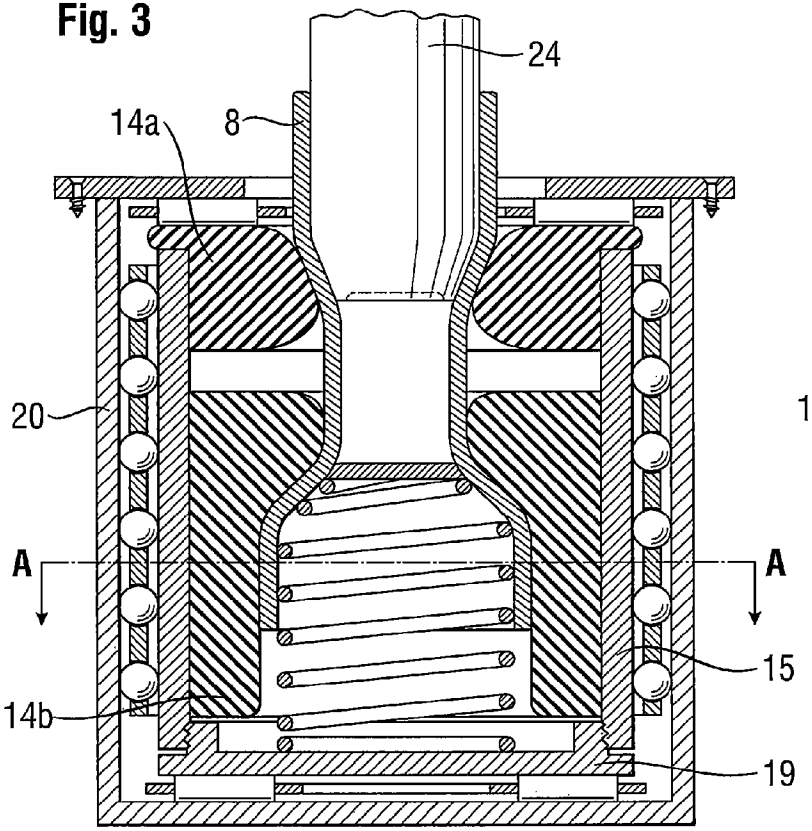
Figure 5:
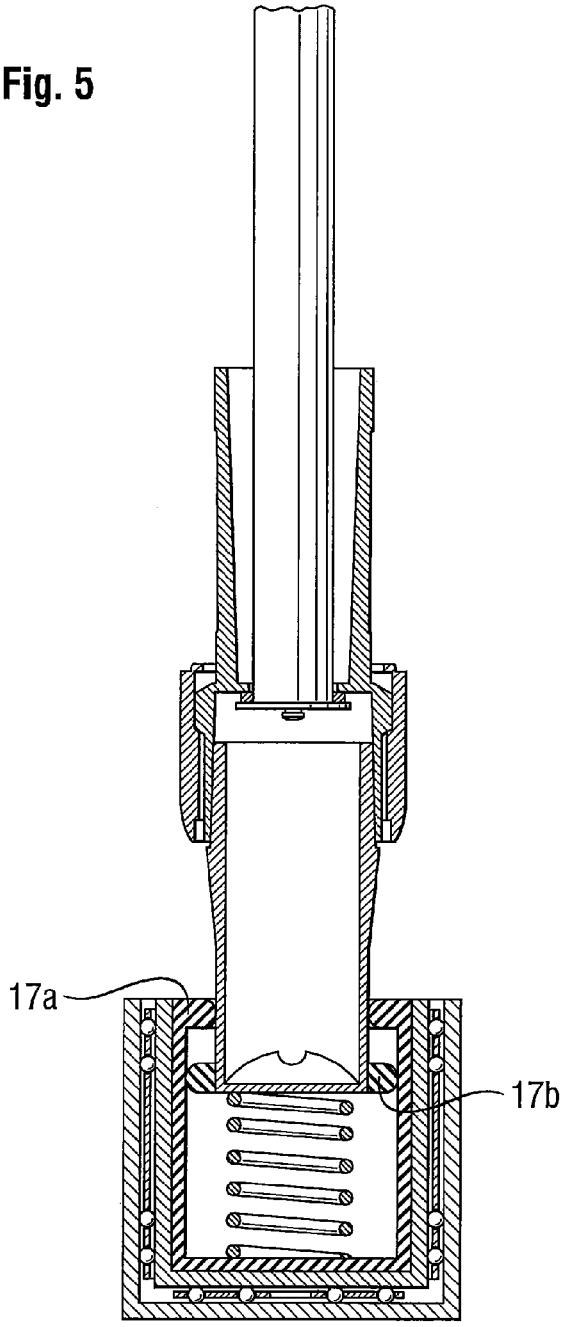

Other advantageous further embodiments of the invention are characterized in the sub-claim as detailed in the following together with the description of the preferred embodiment with reference to the figures in which:

FIG. 1 is a side view of an item of seating furniture,

FIG. 2*a* is a section view of a seating furniture item in accordance with the invention in the unloaded condition, FIG. 2*b* is a section view of a seating furniture item in accordance with the invention in the loaded condition, FIG. 3 is a section view of a further embodiment of a seating furniture item in accordance with the invention, FIG. 4 is a section view through a control element of the seating furniture item, and FIG. 5 is a section view of a further embodiment of a pendulum device in the unloaded condition.

DETAILED DESCRIPTION OF THE EXAMPLE EMBODIMENTS AS SHOWN IN THE FIGURES

Referring now to FIG. 1 there is illustrated a seating furniture item 1 including a seat 2, a column 3, a base 4, a spring device 5 for cushioning the up and down movement of the seat and a pendulum device 6 for inducing a pendular response of the column by means of the seat.

The seat 2 has the shape of a truncated cone with a convex curved base. The column 3 is enclosed by a spring device 5 and comprises a telescopic two-part design permitting spring accommodation and height adjustment of the seat. The column 3 is mounted by a pendelum device 6 for inducing the pendular response of the column by means of the seat. The pendelum device 6 is in turn mounted by a base 4 which in accordance with the usual safety standard is configured as a five-star, circular or three-quarter circular base.

Referring now to FIG. 2*a* there is illustrated an embodiment of the device in accordance with the invention for automatically setting the pendular return force in accordance with the weight of the person using the seat.

Referring still to FIG. 2*a* there is illustrated the column 3 with the spring device 5 and the pendelum device 6 showing most of the column 3 and the pendelum device 6 in full. In this embodiment the column 3 comprises a gas strut 24, an adapter 25 and a circlip 26. The adapter 25 and the circlip 26 are configured so that the adapter 25 clamps the control element 8 fixed by means of the circlip 26.

Topping the circlip 26 is the spring device 5. The pendelum device 6 comprises a tubular housing 15 the bottom end of which is closed off by a cover 19.

Installed within the pendelum device 6 are two elastomeric elements, the one upper elastomeric element 14*a* of which closes off flush the semi-open tube of the pendelum device 6.

The other, lower elastomeric element 14*b* extends instead from the cover 19 to two-thirds of the height of the tube at the most. It is to be noted, however, that both elastomeric elements 14*a*,14*b* may also be engineered in one piece.

The upper elastomeric element 14*a* and lower elastomeric element 14*b* constitute a mount for a control element 8, the distance between the points of contact of the elastomeric elements 14*a*, 14*b* and the control element 8 representing a lever arm variable in length.

Whilst a striking point A materializes at the upper elastomeric element 14*a* on the line of contact between the upper elastomeric element 14*a* and the control element 8 a pendulum fulcrum P materializes at the point of contact between the lower elastomeric element 14*b* and the control element 8.

The distance between the points A and P corresponds to a lever arm, the variability of which is determined by the spring 12. The longer this lever arm is, the more difficult it is for the seating surface to wobble laterally, since the heavier the person using the seat the more the spring 12 is compressed in thus causing the variable pendulum fulcrum to wander downwards.

In other words, the longer the lever arm the higher the force counteracting wobbling of the seating surface. But in any case the consequence of both considerations is that the lateral wobble of the seating surface is restricted.

The control element 8 is configured as a hollow cylinder, closed off at one end within the pendelum device 6.

The closed off end of the control element 8 is bottomed by a funnel-shaped mount 27 to prevent the control element 8 from being pulled out of place. At the open end of the mount 27 the ends are formed so that run parallel to the vertical sealing surfaces of the lower elastomeric element 14*b*.

Furthermore said funnel-shaped mount 27 forms a mount for a spring 12 which is compressed in accordance with the weight bearing on the control element 8, resulting in, as already described, the length of the variable lever arm being altered between the points A and P as a result of which the lateral wobble of the seat 2 is rendered less the longer the length. In other words, the longer the lever arm the more the force counteracting the lateral wobble of the seating surface.

Unlike the upper elastomeric element 14*a* the lower elastomeric element 14*b* is configured shell-like so that the funnel-shaped mount can slide along this shell by its angled end rims.

Referring now to FIG. 2*a* two different embodiments of the lower elastomeric element 14*b* are shown, namely, for one thing, as a simple hollow cylinder shell (shown on the left) and, for another, as a hollow cylinder shell ramped inwardly (shown on the right). Above the upper elastomeric element 14*a* likewise a ramp is featured on the outer side of the control element 8. This serves to stiffen the control element 8 with the upper elastomeric element 14*a* on sinking of the control element 8 in thus additionally restricting the lateral wobble of the seat 2 to lengthen the lever arm and its increase in force. It is in this way that the mounting assembly is stiffened in part involving both an additional increase in force and a reduction in the play.

Referring now to FIG. 2*b* there is illustrated the structure identical to that as shown in FIG. 2*a* except in the sunk or loaded condition, resulting in the spring 12 being compressed, the control element 8 sunk downwards, the mount 27 connected to the lower elastomeric element 14*b* sliding along downwards and the ramp at the outer side of the control element 8 tightly engaging the upper elastomeric element 14*a*. The difference in the travel between the loaded condition or location of the point P and the unloaded condition is the sinking travel having the property of the greater the sinking travel the more the lateral wobble of the seat 2 is restricted, this thus being analogous to the lever arm.

In addition, FIG. 2*b* shows a further possibility of realizing the lower elastomeric element 14*b*, namely by it being engineered in a total of three parts, two of which form the ramp whilst the third part forms a hollow cylinder shell.

Referring now to FIG. 3 there is illustrated a similar embodiment of the pendelum device 6 in accordance with the invention as shown in FIGS. 2*a* and 2*b* except that the pendelum device 6 or its housing 15 is held in a support 20. For freedom of movement of the housing 15 of the pendelum device 6 in relation to the support 20 diverse bearing assemblies are provided in the interspace, involving both ball bearings and needle bearings, it being understood, however, that other types of bearings are not excluded.

So that the pendelum device 6 cannot be pulled out of its support 20 the top end of the cupped support is closed off by a circular disk 28.

Unlike the situation as shown in FIG. 2 the cover 19 bottoming the housing 15 of the pendelum device 6 is not a press-fit but screwed into place in thus making it possible to subsequently tweak the preload of the spring 12.

Referring now to FIG. 4 there is illustrated a section through the support including the pendelum device 6 arranged therein as taken along the line A-A. As evident from this section, grooves 10 are machined in the circumference of the control element 8 engaging the elastomeric elements 14*a*, 14*b* so that the control element 8 cannot turn out of place relative to the elastomeric elements 14*a*, 14*b*

It is in this way that the control element 8 and the elastomeric elements 14*a*, 14*b* are always specifically oriented in location. It is also evident from the section that the lower elastomeric element 14*b* comprises at least one portion 18 which differs from the other portions. This relative difference in the individual portions makes for the changes in the degree of hardness of the elastomer, in thus achieving, for example, the elastomer responding harder as soon as the person using the seat tends to stoop in position contrary to the positive effect of the user being actively dynamic seated. For the person using the seat to be able to orient his position he must be seated so that the harder elastomeric portion counteracts the stoop. This is achieved by a backrest being provided on the seating furniture item.

It is thus this combination of the configuration of the grooves 10 at the control element 8 with the difference in hardness of the various portions of the elastomeric element that stooping with its negative consequences in health is now cleverly prevented.

Due to the present invention being engineered with two elastomeric elements 14*a*, 14*b* the lower elastomeric element 14*b* has to be arranged mirror-inverted to the upper elastomeric element 14*a* as regards the difference in hardness within the elastomeric elements.

Referring now to FIG. 5 there is illustrated a further embodiment of the seating furniture item in accordance with the invention or of its pendelum device 6 in which an upper and lower elastomeric element are replaced by a single elastomeric element 17*a* fixedly arranged in the housing 15 of the pendelum device 6 more or less the same in shape but with the open end formed toroidal to prevent an elastomeric element 17*b* secured to the pendelum device 6 from being pulled off.

It is understood that the invention is not limited to the aspects as detailed above by way of the examples. Instead, a wealth of other variants is feasible in making use of the basic achievement even though engineered differently. Thus, protected by the scope of the invention as described is to replace the elastomeric elements by suitable metal or plastic springs.

LIST OF REFERENCE NUMERALS

1 item of seating furniture
2 seat
3 column
4 base
5 spring device
6 pendelum device
7 device
8 control element
9 end
10 groove
11 mount
12 spring
13 mount for gas strut
14*a* upper elastomeric element
14*b* lower elastomeric element
15 housing
16 mount for toroidal elastomeric element
17*a* elastomeric element
17*b* elastomeric element
18 portion with differing degree of hardness
19 cover
20 support
21 bearing assembly
22 support cover
23 star base
24 gas strut
25 adapter
26 circlip
27 mount
28 circular disk
E sinkage travel
P pendulum fulcrum
A striking point

What is claimed is:

1. A seating furniture item comprising
a seat,
a column,
a base,
a spring device for cushioning the up and down movement of the seat,
a pendulum device for inducing a pendular response of the column by means of the seat, and
a device for automatically adjusting the pendular return force in accordance with the weight of a person occupying the seat; wherein
said column or a part of the column or a control element has a sinking movement in use of the seat by a person, travel of said column or said part of said column or said control element determines a length of a return lever arm between a pendulum fulcrum point and a striking point of a return force based upon the weight of the person;
said pendulum fulcrum point is defined by a first surface of said device, a first circular outer surface of said column or said part of said column or said control element being in continuous sliding contact with said first surface to define said pendulum fulcrum point;
said striking point is defined by a second surface of said device, a second circular outer surface of said column or said part of said column or said control element being in continuous sliding contact with said second surface to define said striking point; and
said pendulum fulcrum point being moveable with respect to said striking point to determine the length of the return lever arm based on the weight of the person.

2. The seating furniture item as set forth in claim 1, wherein said control element is configured as a hollow cylinder.

3. The seating furniture item as set forth in claim 2, wherein said control element comprises at least one closed end.

4. The seating furniture item as set forth in claim 2, wherein said control element comprises a mount for a spring at an outer side of a closed end.

5. The seating furniture item as set forth in claim 4, wherein said mount is configured funnel-shaped.

6. The seating furniture item as set forth in claim 5, wherein said mount is configured as an elastomeric element.

7. The seating furniture item as set forth in claim 2, wherein a part of the hollow cylinder is ramped on its outer side.

8. The seating furniture item as set forth in claim 2, wherein a mount for a gas strut is provided within the control element.

9. The seating furniture item as set forth in claim 2, wherein part of the hollow cylinder is configured ramped on its outer side.

10. The seating furniture item as set forth in claim 1, wherein said control element comprises at least one circumferential groove.

11. The seating furniture item as set forth in claim 1, wherein a mount is arranged at a cylindrical bottom of the control element.

12. The seating furniture item as set forth in claim 1, wherein said pendulum device comprises a housing.

13. The seating furniture item as set forth in claim 12, wherein said housing is tubular in shape.

14. The seating furniture item as set forth in claim 13, wherein said tubular housing comprises a cover.

15. The seating furniture item as set forth in claim 14, wherein said housing of the pendulum device or the cover comprises a device for tweaking the preloading of the spring.

16. The seating furniture item as set forth in claim 12, further comprising at least one toroidal elastomeric element, wherein said housing features at least one mount for said at least one toroidal elastomeric element.

17. The seating furniture item as set forth in claim 16, wherein at least one elastomeric element is arranged within the housing of the pendulum device.

18. The seating furniture item as set forth in claim 16, wherein said at least one elastomeric element is arranged at the open end of the housing of the pendulum device.

19. The seating furniture item as set forth in claim 16, wherein said at least one elastomeric element has a diameter equal to or smaller than a diameter of the control element.

20. The seating furniture item as set forth in claim 16, wherein said at least one elastomeric element comprises at least one portion with a differing degree of hardness.

21. The seating furniture item as set forth in claim 20, wherein said at least one portion is arranged at the circumference.

22. The seating furniture item as set forth in claim 21, wherein said at least one portion of the elastomeric element comprises a degree of hardness which differs from that of the remaining portion of the elastomeric element.

23. The seating furniture item as set forth in claim 12, wherein said housing comprises an interior spring.

24. The seating furniture item as set forth in claim 12, wherein said housing of the pendulum device is arranged rotatable in a support.

25. The seating furniture item as set forth in claim 24, wherein disposed between the housing of the pendulum device and the support is at least one bearing assembly.

26. The seating furniture item as set forth in claim 25, wherein said bearing assembly comprises a cover preventing the housing of the pendulum device from being pulled out.

27. The seating furniture item as set forth in claim 26, wherein said support is arranged on a star base.

28. The seating furniture item as set forth in claim 1, wherein the length of the return lever arm increases with an increase of the weight of the person.

* * * * *